US005803879A

United States Patent [19]

Huang

[11] Patent Number: 5,803,879

[45] Date of Patent: Sep. 8, 1998

[54] DOUBLE-ACTING HYDRAULIC CYLINDER FOR USE IN AN EXERCISING APPARATUS

[76] Inventor: Chen-tan Huang, 3F., No. 7-2, Alley 10, Kungyuan Rd., Hsinchuang City, Taipei Hsien, Taiwan

[21] Appl. No.: 775,568

[22] Filed: Dec. 31, 1996

Related U.S. Application Data

[63] Continuation-in-part of Ser. No. 697,189, Aug. 20, 1996, Pat. No. 5,618,248.

[51] Int. Cl.[6] ..... A63B 21/008

[52] U.S. Cl. ..... 482/112; 482/111; 482/113

[58] Field of Search ..... 482/51, 92, 111–113, 482/53, 58, 73; 188/151 R, 361–363, 266, 269

[56] References Cited

U.S. PATENT DOCUMENTS

| | | | |
|---|---|---|---|
| 4,801,139 | 1/1989 | Vanhoutte et al. | 482/112 |
| 5,011,142 | 4/1991 | Eckler | 482/113 |
| 5,397,287 | 3/1995 | Lindfors | 482/113 |

*Primary Examiner*—Richard J. Apley
*Assistant Examiner*—Glenn E. Richman
*Attorney, Agent, or Firm*—William E. Pelton

[57] ABSTRACT

A double-acting hydraulic cylinder consists of a cylindrical body having an inner wall and an outer wall and a piston rod attached with a piston movably mounted within the inner wall and dividing a space within the inner wall into a rear chamber and a front chamber. A rear seat is mounted on a rear end of the body and defines a first bypass communicating a first space between the inner and outer walls with the rear chamber. A front seat is mounted on a front end of the body. A block is mounted between the piston and the front seat and defines a second bypass communicating the first space and the front chamber. The front seat defines a first control channel and a second control channel which communicate with each other at a common end and a communication conduit in communication with a communication tube in communication with the rear chamber. A sleeve is rotatably mounted on the piston rod and comprises a first passage in communication with the front chamber, a second passage in communication with first passage and the first control channel and a third passage in communication with the second control channel and the communication conduit.

10 Claims, 7 Drawing Sheets

DOUBLE-ACTING HYDRAULIC CYLINDER FOR USE IN AN EXERCISING APPARATUS

The present invention is a Continuation-in-part Application of U.S. patent application Ser. No. 08/697,189, U.S. Pat. No. 5,618,248, filed Aug. 20, 1996.

FIELD OF THE INVENTION

The present invention is related to a double-acting hydraulic cylinder, particularly to a double-acting hydraulic cylinder used in an exercising apparatus to provide a resistance to a user of the exercising apparatus.

BACKGROUND OF THE INVENTION

Double-acting hydraulic cylinders are now widely used in exercising apparatuses to provide a resistance to a user who is exerting a force on the cylinder thereby to strengthen his (her) muscles.

However, the conventional double-acting hydraulic cylinder used in an exercising apparatus has the following disadvantages.

Firstly, when a piston of the hydraulic cylinder is forced to move within the hydraulic cylinder from one side to another side, the side of the hydraulic cylinder from which the piston is moved away cannot be immediately supplied with hydraulic oil in the hydraulic cylinder; thus, when a user exerts a pulling force immediately following exerting a pushing force on the hydraulic cylinder, at the beginning of the pulling operation, he (she) will experience a period of operation in which there is substantially no resistance from the hydraulic cylinder, which causes the operation of the apparatus to be not smooth.

Secondly, since the resistance obtainable from the conventional hydraulic cylinder is constant, the versatility of the conventional hydraulic cylinder is limited. The resistance of the conventional hydraulic cylinder cannot be adjusted to meet the different requirements of different users; for example, an adult may require a heavy resistance and a youth may require a light resistance from the hydraulic cylinder.

The present invention therefore is aimed to provide an improved double-acting hydraulic cylinder used in an exercising apparatus to mitigate and/or obviate the aforementioned problems.

SUMMARY OF THE INVENTION

It is an objective of the present invention to provide a double-acting hydraulic cylinder wherein when a piston of the hydraulic cylinder is forced to move within the hydraulic cylinder from one side to another side, the side of the hydraulic cylinder from which the piston is moved away can be immediately supplied with hydraulic oil in the hydraulic cylinder Another object of the present invention is to provide a double-acting hydraulic cylinder wherein the resistance obtainable from the hydraulic cylinder is adjustable.

A further objective of the present invention is to provide a double-acting hydraulic cylinder wherein the resistance of the hydraulic cylinder can be adjusted by simply rotating a single control ring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
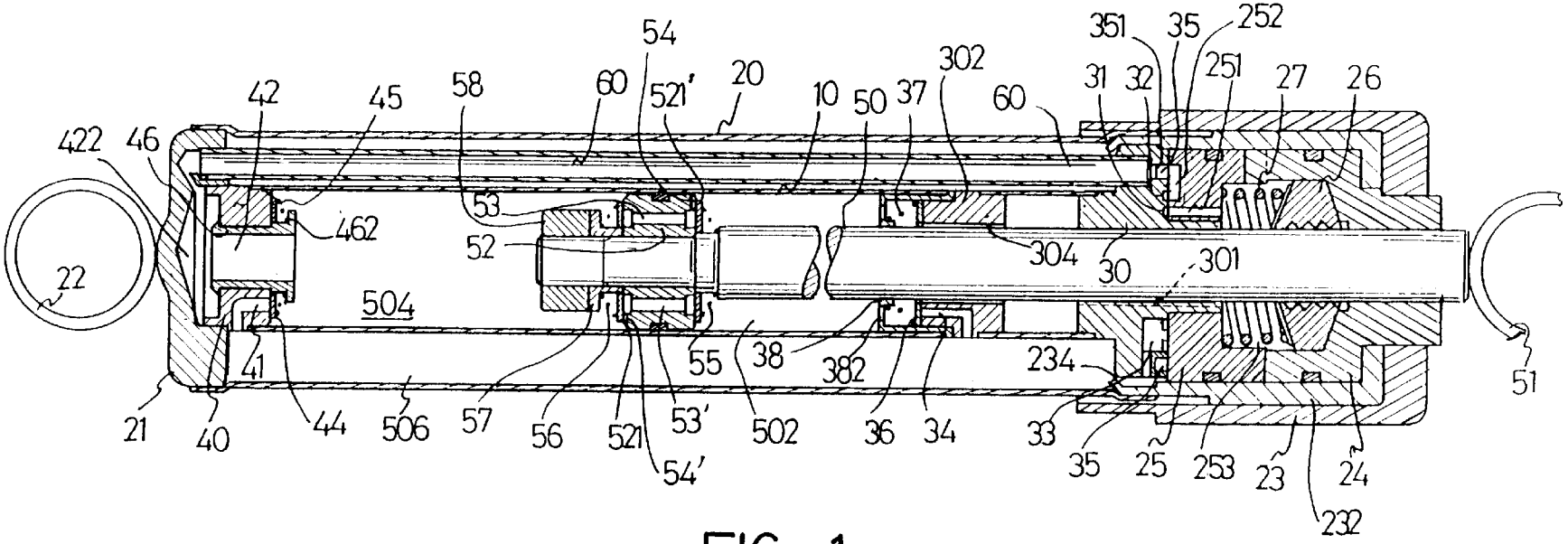
FIG. 1 is a cross-sectional view showing a double-acting hydraulic cylinder in accordance with a first embodiment of the present invention.
Figure 2:
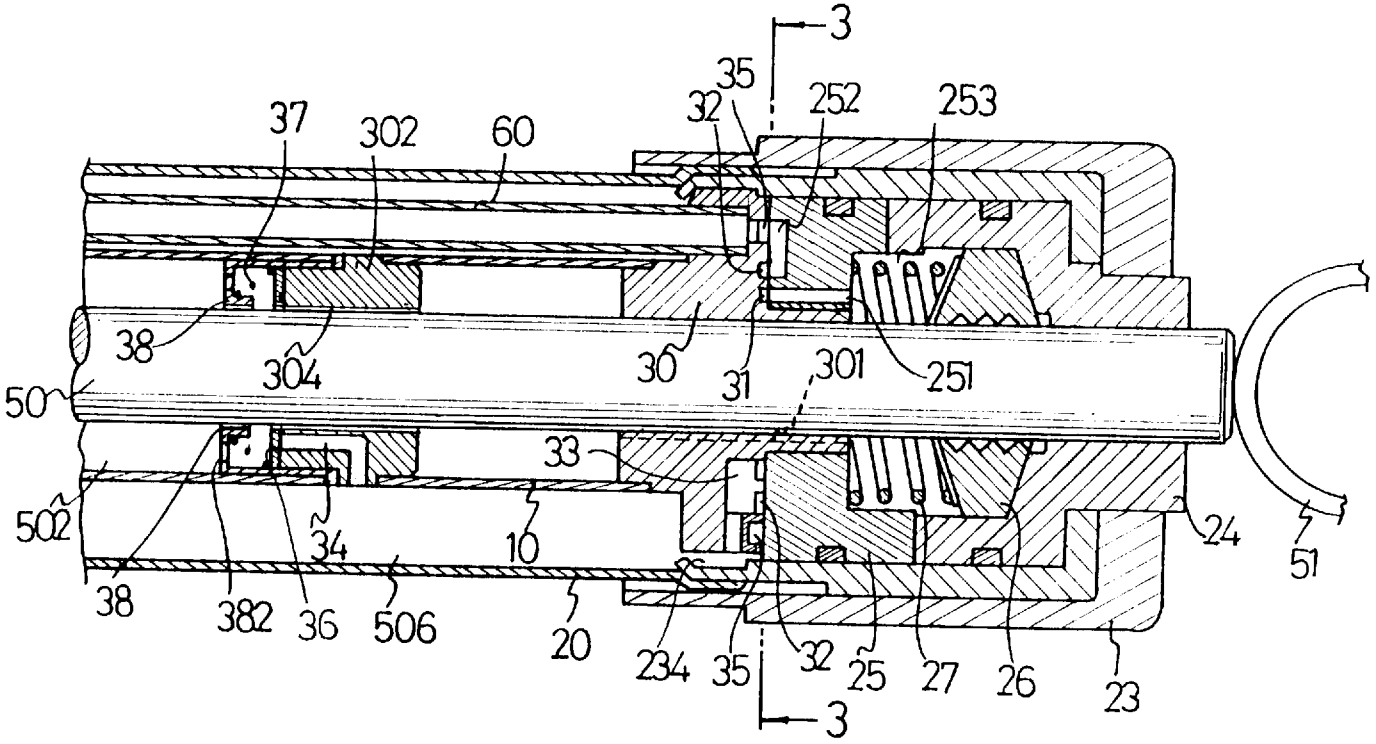
FIG. 2 is a partial and enlarged view of FIG. 1.
Figure 5:
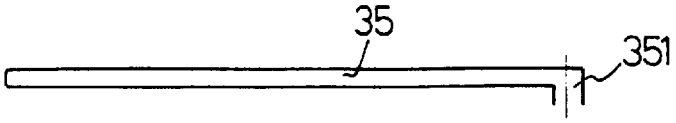
FIG. 5 is a view similar to FIG. 4 but showing the change of depth along the length of a communication conduit.

Refer to FIGS. 1 to 5 which show a first embodiment of a double-acting hydraulic cylinder in accordance with the present invention. The hydraulic cylinder is mounted on an exercising apparatus (not shown) to provide a resistance to a user of the exercising apparatus whereby the user's muscles may be exercised.

The hydraulic cylinder generally consists of a cylindrical body defining an outer wall 20 and an inner wall 10, a communicating tube 60 extending between the outer wall 20 and the inner wall 10, a front seat 30 fixedly mounted on a front end of the body and a rear seat 40 fixedly mounted on a rear end of the body. A rear cap 21 is hermetically and fixedly mounted on the rear end of the body and houses a rear portion of the rear seat 40. A rear ring 22 is fixedly attached on the rear cap 21. The rear ring 22 is also fixedly connected to the exercising apparatus (not shown).

A piston rod 50 is slideably mounted in the inner wall 10. A front ring 51 fixedly attached on a front end of the piston rod 50. The front ring 51 is used to connect with a suitable means (not shown) for the user to grip so that the user can exert a pushing or pulling force on the hydraulic cylinder.

A piston 52 is fixedly mounted on a rear portion of the piston rod So and hermetically engages with the inner wall 10. The piston 52 divides an inner space of the inner wall 10 into a front chamber 502 and a rear chamber 504. An upper hole 53 and a lower hole 53' are respectively defined in an upper portion and a lower portion of the piston 52. The upper hole 53 has a front end communicating with the front chamber 502 via a first slit 54 and a rear end normally being closed by a first disk 521. The lower hole 53' has a front end normally being closed by a second disk 521' and a rear end communicating with the rear chamber 504 via a second slit 54'. A first spring 55 is mounted between the second disk 521' and the piston rod 50 to exert a pushing force on the second disk 521'. A second spring 56 is mounted between the first disk 521 and a first stop member 57 to exert a pushing force on the first disk 521. A nut 58 is threadedly engaged with a rear end of the piston rod 50 to fixedly mount the first stop member 57, the second spring 56, the first disk 521, the piston 52, the second disk 521' and the first spring 55 on the rear portion of the piston rod 50.

A second stop member 46 is formed to have a central hole 42 communicating the communicating tube 60 with the rear chamber 504 via a first space 422 between the rear seat 40 and the rear cap 21. The rear seat 40 is formed with a first L-shaped bypass 41 having a rear end in communication with a second space 506 defined between the outer wall 20 and the inner wall 10 and a front end normally closed by a third disk 44. The second stop member 46 is fixedly fitted in a central portion of the rear seat 40 and defines a front flanged end 462. The third disk 44 is mounted around the second stop member 46 and is pushed toward to the rear seat 40 by a third spring 45 compressed between the third disk 44 and the front flanged end 462 of the second stop member 46.

A block 302 which defines a second L-shaped bypass 34 is mounted between the piston rod 50 and the inner wall 10. The second L-shaped bypass 34 communicates the second space 506 defined between the inner and outer walls 10 and 20 with the front chamber 502. The block 302 is located a distance behind the front seat 30. The block 302 defines a plurality of first communicating passages 304 extending therethrough and located neighboring the piston rod 50. A cup-shaped third stop member 38 is mounted between the inner wall 10 and the piston rod 50 and located a distance behind the block 302. The third stop member 38 has a front end clamped between the inner wall 10 and the block 302 and defines a plurality of bores 382 on a rear side thereof. A fourth disk 36 is mounted around the piston rod 50 and located between the block 302 and the third stop member 38. A fourth spring 37 is compressed between the third stop member 38 and the fourth disk 36 to push the fourth disk 36 toward the second L-shaped bypass 34 and thus the second L-shaped bypass 34 is normally closed by the fourth disk 36.

Figure 3:
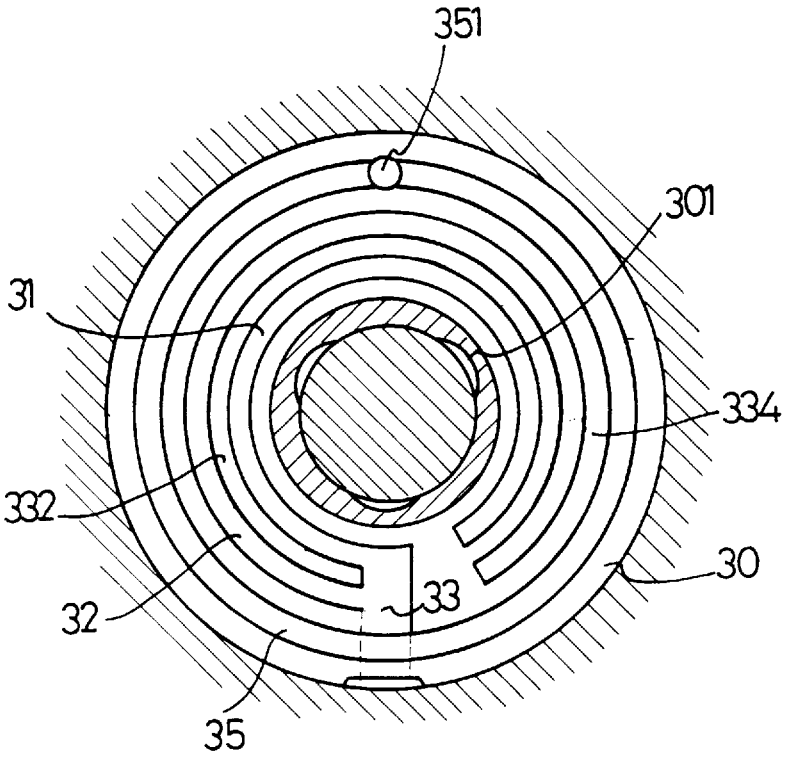
FIG. 3 is a view taken along line 3—3 of FIG. 2.

Particularly referring to FIG. 3, the front seat 30 is formed to have a first control channel 31, a second control channel 32, a communicating channel 33 and a communication conduit 35 defined in a rear end face of the front seat 30. The first and second control channels 31, 32 are communicated with the communicating channel 33 and each other at a common end thereof. At the portion other than the common end, the first and second control channels 31, 32 are separated from each other by a first partition 332 formed by the front seat 30 and located between the two channels 31, 32. A plurality (three) of second communicating passages 301 are defined in an inner periphery of the front seat 30.

The second communicating passages 301 are communicated with the front chamber 502 via the first communicating passages 304 and the bores 382 in the third stop member 38. The communication conduit 35 is formed into a circular conduit portion with a communication hole 351. The communication hole 351 is arranged in communication with the communicating tube 60. The communication conduit 35 is separated from the first and second control channels 31 and 32 and the communicating channel 33 by a second partition 334 formed by the front seat 30 and located between the communication conduit 35 and the second control channel 32 .

Figure 4:
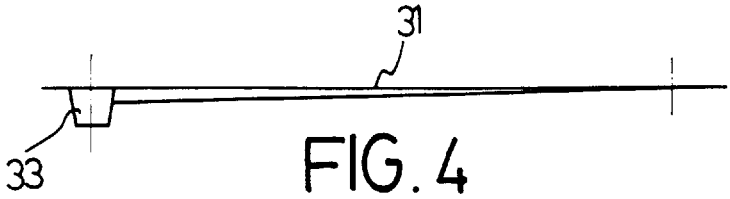
FIG. 4 is a diagrammatical view showing the change of depth along the length of a first control channel.

Particularly referring to FIG. 4, the first control channel 31 has a depth variable along a length thereof. The first control channel 31 has a depth gradually increasing from a distal end to the end near the communicating channel 33. The second control channel 32 has a similar configuration as the first control channel 31. Particularly referring to FIG. 5, unlike the control channels 31 and 32, the communication conduit 35 has a constant depth from the communication hole 351.

Referring back to FIGS. 1 and 2, a first sleeve 25 is rotatably mounted on a rear end of the front seat 30 and defines a lower passage 251 in communication with the first control channel 31 and an upper passage 252 in communication with the communicating tube 60 via the communication conduit 35 and the communication hole 351 and the second control channel 32 wherein the circular conduit portion of the communication conduit 35 is always kept in communication with the upper passage 252 irrespective of rotation of the first sleeve 25.

A second sleeve 24 has a rear end fixedly connected with a rear end of the first sleeve 25 and a front end rotatably mounted the front end of the piston rod 50. When the second sleeve 24 is rotated, the first sleeve 25 rotates accordingly. A third space 253 is defined between the first sleeve 25 and the second sleeve 24. The third space 253 is in communication with the lower passage 251 defined by the first sleeve 25 and the second communicating passages 301 defined by the front seat 30. A large seal 26 is mounted in the third space 253 and hermetically engages with the piston rod 50. A fifth spring 27 is compressed between the large seal 26 and the first sleeve 25.

A control ring 23 is fixedly mounted on a front end of the second sleeve 24 so that when the control ring 23 is rotated, the second sleeve 24 rotates accordingly. A mounting ring 232 is mounted between the control ring 23 and the first and second sleeves 25, 24 and has a rear end fixedly and hermetically engaging with a front end of the outer wall 20. A third slit 234 is defined between the mounting ring 232 and the front seat 30. The communicating channel 33 is communicated with the second space 506 via the third slit 234.

A small seal (not labeled) is respectively mounted on the first sleeve 25 and the second sleeve 24 to provide a hermetical engagement between the first and second sleeves 25, 24 and the mounting ring 232.

The following description is related to how the hydraulic cylinder in accordance with the present invention works.

The hydraulic cylinder is filled with oil. When the front ring 51 is pulled by a user to move toward the right of FIG. 1, a minor portion of the oil in the front chamber 502 will firstly flow backwardly through the first slit 54 and the upper hole 53 to open the first disk 521 to enter the rear chamber 504, thereby to facilitate the initial movement of the piston 52; otherwise, since the path for the oil in the front chamber 502 to flow into the rear chamber 504, which includes the first and second communicating passages 304 and 301, the lower and upper passages 251 and 252 defined by the first sleeve 25, the communicating tube 60, etc., is relatively long, an initial movement of the piston 52 may only compress the oil, which causes the initial movement of the piston 52 to become very difficult.

During the movement of the piston 52 toward the right, a major portion of the oil in the front chamber 502 will flow through the bores 382, the first communicating passages 304, the second communicating passages 301, the third space 253, the lower passage 251 defined by the first sleeve 25 to enter the first control channel 31 defined in the rear end face of the front seat 30. The oil entering the first control channel 31 will have a portion flowing through the second control channel 32, the communication conduit 35, the communication hole 351, the communicating tube 60, the first space 422, the central hole 42 of the second stop member 46 to enter the rear chamber 504 and a further portion flowing into the second space 506 defined between the inner wall 10 and the outer wall 20 via the communicating channel 33 and the third slit 234. The oil entering the second space 506 then will flow into the rear chamber 504 via the first L-shaped bypass 41.

Moreover, immediately after the piston 52 is moved to the right, a vacuum pressure will be created in the rear chamber 504. The vacuum pressure will induce the third disk 44 to leave the front end of the first L-shaped bypass 41 and the oil already existing in the second space 506 defined between the inner wall 10 and the outer wall 20 to immediately flow into the rear chamber 504.

Alternatively, when the piston 52 is pushed toward the left, a minor portion of the oil in the rear chamber 504 will flow forwardly through the second slit 54' and the lower hole 53' to open the second disk 521' to enter the front chamber 502 to facilitate the initial movement of the piston 52.

Moreover, immediately after the piston 52 is moved to the left, a vacuum pressure will be created in the front chamber 502. The vacuum pressure will induce the fourth disk 36 to leave the rear end of the second L-shaped bypass 34 and the oil in the second space 506 defined between the inner wall 10 and the outer wall 20 to immediately flow into the front chamber 502 via the L-shaped bypass 34 and the bores 382.

Since in this embodiment, the L-shaped bypass 34 is located nearer a center of the hydraulic cylinder, even if the cylinder is not fully filled with oil, when the piston rod 50 is pushed to the left in the drawings, oil in the second space 506 defined between the inner wall 10 and the outer wall 20 also can quickly flow into the front chamber 502 via the L-shaped bypass 34.

During the movement of the piston toward the left, a major portion of the oil in the rear chamber 504 will flow through the central hole 42 of the second stop member 46, the first space 422, the communicating tube 60, the communication hole 351, the communication conduit 35, the upper passage 252 of the first sleeve 25 to enter the second control channel 32. The oil entering the second control channel 32 then will have a portion flowing into the second space 506 defined between the inner wall 10 and the outer wall 20 via the communicating channel 33 and the third slit 234, and a further portion flowing through the first control channel 31, the lower passage 251 of the first sleeve 25, the third space 253, the second communicating passages 301 of the rear seat 30, the first communicating passages 304 of the block 302 and the bores 382 of the third stop member 38 to enter the front chamber 502.

No matter whether the piston 52 is moved to the left or the right, the chamber 504 or 502 can be immediately supplied with the hydraulic oil in the second space 506 defined between the inner wall 10 and the outer wall 20 via the bypass 41 or 34; thus, the hydraulic cylinder in accordance with the present invention can enable a user thereof to very smoothly operate the exercising apparatus.

Furthermore, by rotating the control ring 23 to rotate the first sleeve 25 via the second sleeve 24 to change the position of the lower and upper passages 251 and 252 of the first sleeve 25 relative to the first and second control channels 31 and 32 of the front seat 30, the cross-sectional area of the channel by which the oil can flow from the rear chamber 504 to the front chamber 502 or vice versa can be changed, the counterpressure of the hydraulic oil acting on the piston 52 when the piston 52 is forced to move can be changed; thus, the resistance of the hydraulic cylinder in accordance with the present invention can be adjusted by simply rotating a single control ring.

Figure 6:
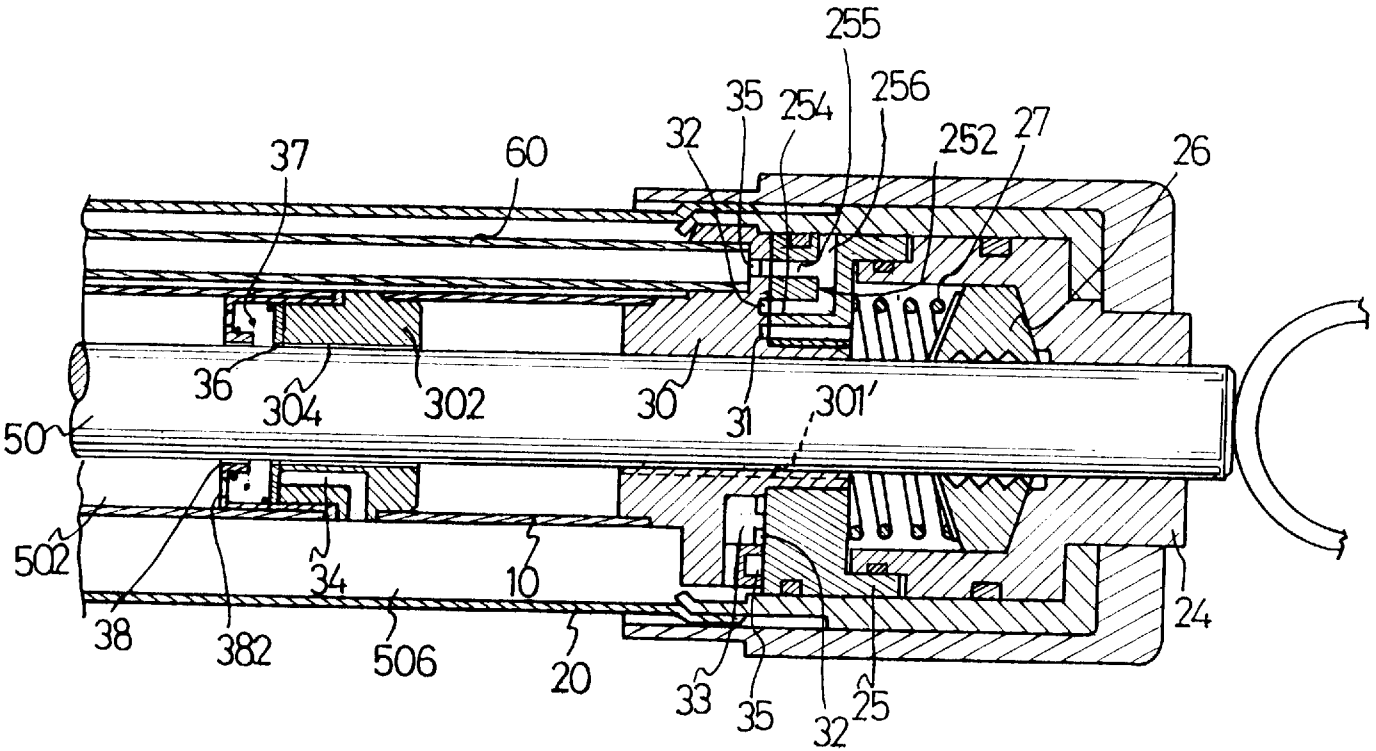
FIG. 6 is a view similar to FIG. 2 but showing a second embodiment of the present invention.

FIG. 6 shows a second embodiment of the present invention which, except the addition of a small seal (not labeled) between the first and second sleeves 25, 24 and the configuration of the upper passage 252, has a structure substantially the same as that of the first embodiment. In the first embodiment, the upper passage 252 is defined as a single recess simultaneously in communication with the second control channel 32 and the communication conduit 35 while in the second embodiment, the upper passage 252 defines a first horizontal blind hole 254 in communication with the second control channel 32, a second horizontal blind hole 255 in communication with the communication conduit 35 and a vertical blind hole 256 connecting the first and second horizontal blind holes 254 and 255.

Figure 7:
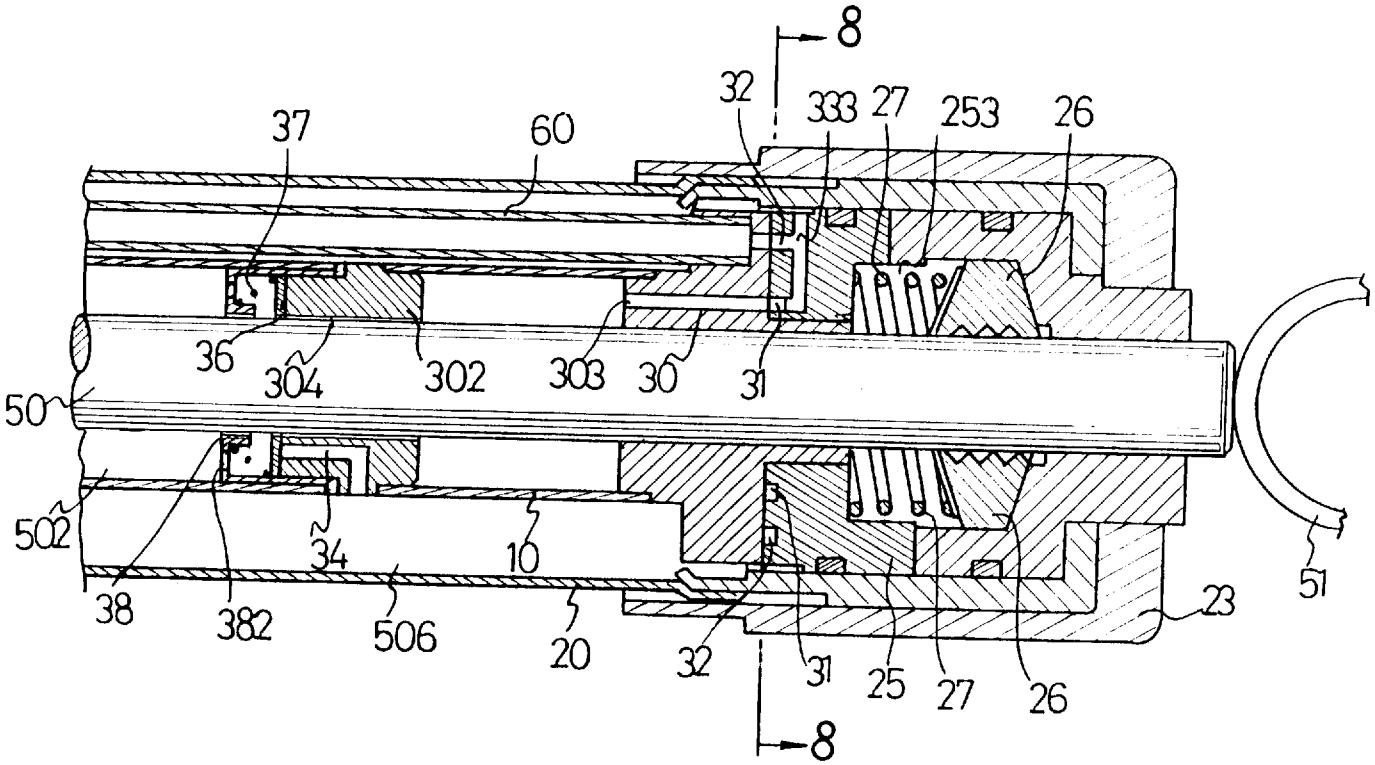
FIG. 7 is a view similar to FIG. 2 but showing a third embodiment of the present invention.
Figure 8:
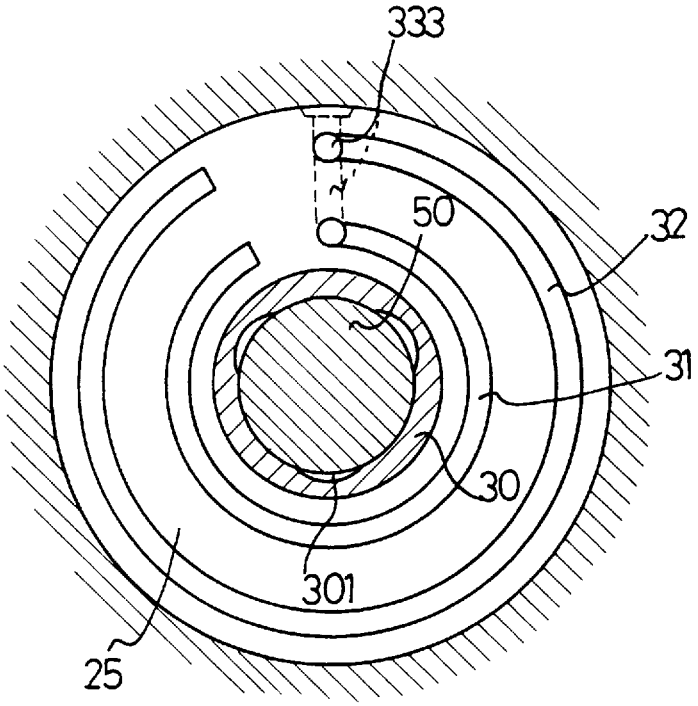
FIG. 8 is a cross-sectional view taken along line 8—8 of FIG. 7.

FIGS. 7 and 8 show a third embodiment of the present invention. Except for the following differences, the third embodiment has a structure substantially the same as that of the first embodiment. In the third embodiment, the front seat 30 defines a hole 303 axially extending therethrough. The first sleeve 25 defines a first control channel 31 in communication with the hole 303, a second control channel 32 in communication with the communicating tube 60, and a communicating hole 333 connecting the first and second control channels 31 and 32.

As in the control channels in the first embodiment, each of the control channels in the third embodiment also has a variable depth along its length whereby the resistance of the hydraulic cylinder can be adjusted when the first sleeve 25 is rotated relative to the front seat 30 by rotating the control ring 23.

In the third embodiment, when the piston (not shown) is moved to the right, the oil in the front chamber 502 will flow through the bores 382, the first communicating passages 304, the hole 303, the first control channel 31, the communicating hole 333, the second control channel 32, the communicating tube 60 to reach the rear chamber 504 (not shown). When the piston is moved to the left, the oil in the rear chamber will flow through the above mentioned path but in a reversed sequence to reach the front chamber 502.

Figure 9:
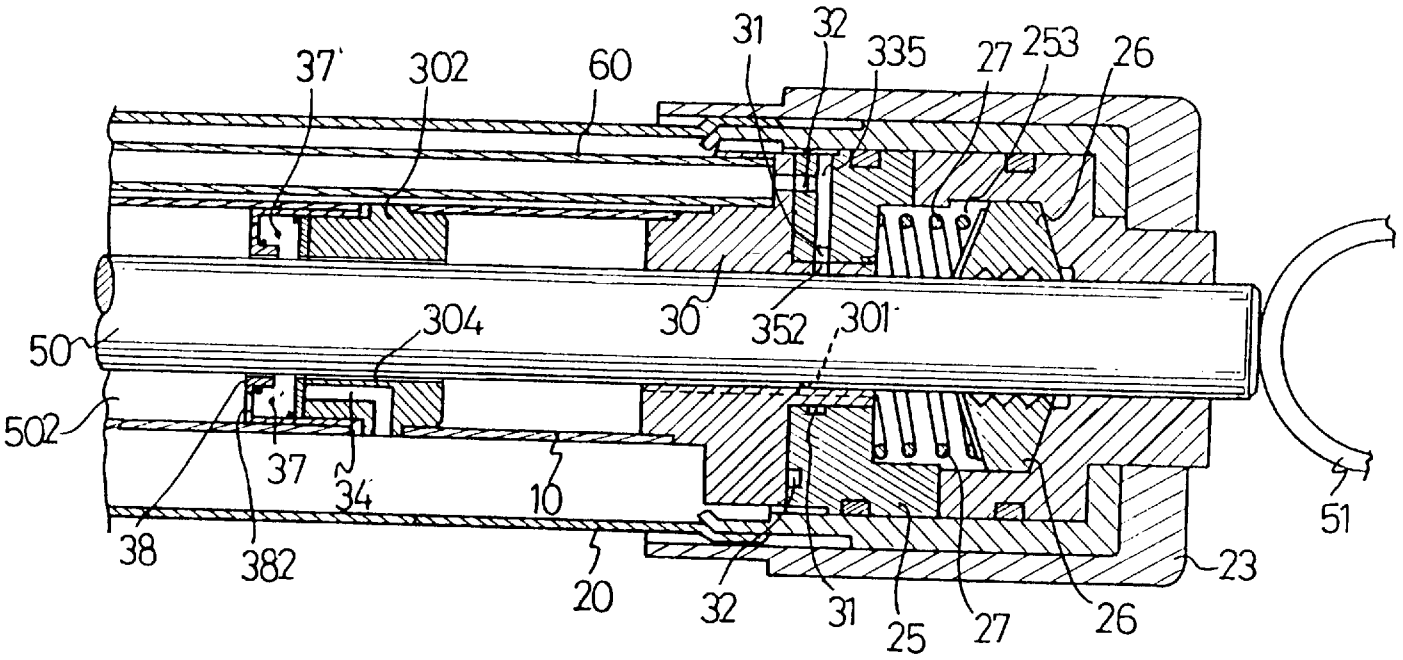
FIG. 9 is a view similar to FIG. 2 but showing a fourth embodiment of the present invention.

FIG. 9 shows a fourth embodiment of the present invention. Except for the following differences, the fourth embodiment has a structure substantially the same as that of the first embodiment. The first and second control channels 31, 32 are respectively formed on a bottom face and a side face of the first sleeve 25. A vertical communicating hole 335 connects the first and second control channels 31, 32, and a communication conduit 352 in the front seat 30 connects the first control channel 31 and the second communicating passages 301. The second control channel 32 is in communication with the communicating tube 60.

As in the control channels in the first embodiment, each of the control channels in the fourth embodiment also has a variable depth along its length whereby the resistance of the hydraulic cylinder can be adjusted when the first sleeve 25 is rotated relative to the front seat 30 by rotating the control ring 23.

In the fourth embodiment, when the piston (not shown) is moved to the right, the oil in the front chamber 502 will flow through the bores 382, the first communicating passages 304, the second communicating passages 301, the communication conduit 352, the first control channel 31, the communicating hole 335, the second control channel 32, the communicating tube 60 to reach the rear chamber (not shown). When the piston is moved to the left, the oil in the rear chamber will flow through the above mentioned path but in a reversed sequence to reach the front chamber 502.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A double-acting hydraulic cylinder for use in an exercising apparatus to provide a resistance to a user thereof, comprising:

a cylindrical body comprising an outer wall and an inner wall and defining a front end and a rear end;

a piston rod extending into an inner space of the inner wall and attached with a piston to divide the inner space into a front chamber and a rear chamber;

a communicating tube extending between the outer and inner walls;

a rear seat mounted on the rear end of the cylindrical body and adapted to be fixedly attached to an exercising apparatus, comprising a first communicating passage communicating the communicating tube with the rear chamber and a first bypass communicating a space defined between the outer and inner walls with the rear chamber;

a first blocking member provided in the rear chamber for normally closing the first bypass, said first blocking member opening the first bypass when the piston is forced to move toward the front end;

a front seat mounted on the front end of the cylindrical body and defining a plurality of first passages extending therethrough and a first control channel and a second control channel and a communicating conduit, said communicating conduit being formed into a circular conduit portion with a communication hole, said communication hole being arranged in communication with the communicating tube, said first and second control channels respectively having a variable depth along their lengths and communicating with each other at a common end by a communicating channel, said communicating channel communicating with the space defined between the inner and outer walls;

a block mounted between the inner wall and the piston rod and located a distance behind the front seat, said block defining a plurality of second passages extending therethrough and communicating with the front chamber and the first passages in the front seat and a second L-shaped bypass communicating the space defined between the inner and outer walls with the front chamber;

a cup-shaped stop member mounted between the inner wall and the piston rod and located a distance behind the block, said stop member having a front end clamped between the block and the inner wall and defining a plurality of bores on a rear side thereof;

a second blocking member provided in the front chamber and located between the stop member and the block;

a spring compressed between the second blocking member and the stop member to push the second blocking member toward the second L-shaped bypass and thus the second L-shaped bypass being normally closed by the second blocking member, said second blocking member opening the second bypass when the piston is forced to move toward the rear end;

a sleeve rotatably mounted around the piston rod and located at a front end of the front seat, said sleeve defining a second communicating passage in communication with the first passages in the front seat and the first control channel and a third communicating passage in communication with the second control channel and the communication conduit, wherein said third communicating passage is always kept in communication with said circular conduit portion of the communication conduit irrespective of rotation of the sleeve;

a control ring fixedly mounted on the sleeve so that when the control ring is rotated, the sleeve rotates accordingly; and a mounting ring mounted between the sleeve and the control ring, said mounting ring having a rear end hermetically and fixedly connected with a front end of the outer wall and an inner periphery hermetically engaging with the sleeve.

2. The double-acting hydraulic cylinder in accordance with claim 1, wherein the sleeve comprises a first sleeve member and a second sleeve member fixedly connected with each other and defining a first space therebetween, said first sleeve member defining the second and third communicating passages, said second sleeve member being fixedly connected to the control ring, a seal being mounted in the first space and hermetically engaging the piston rod and a spring being compressed between the first sleeve member and the seal.

3. The double-acting hydraulic cylinder in accordance with claim 1, wherein the first passages are defined in an inner periphery of the front seat.

4. The double-acting hydraulic cylinder in accordance with claim 1, wherein the piston is formed to have a first hole and a second hole extending to communicate the front chamber with the rear chamber and said hydraulic cylinder further comprises a third blocking member provided in the rear chamber for normally closing the first hole and a fourth blocking member provided in the front chamber for normally closing the second hole, said third blocking member opening the first hole when the piston is forced to move toward the front end of the body, said fourth blocking member opening the second hole when the piston is forced to move toward the rear end of the body.

5. The double-acting hydraulic cylinder in accordance with claim 1, wherein said rear seat further comprises a rear cap to house the rear seat and said rear seat and rear cap define a second space therebetween, said second space communicating the first passage in the rear seat with the communicating tube.

6. The double-acting hydraulic cylinder in accordance with claim 1, wherein the first blocking member is a disk, said disk being pushed to close the first bypass by a spring force.

7. The double-acting hydraulic cylinder in accordance with claim 6, wherein the rear seat comprises a stop member defining a central hole in communication with the rear chamber, a spring being compressed between the disk and the stop member, the first passage of the rear seat communicating the communicating tube with the central hole.

8. The double-acting hydraulic cylinder in accordance with claim 1, wherein the third communicating passage is defined as a single recess.

9. The double-acting hydraulic cylinder in accordance with claim 1, wherein the third communicating passage is defined as a first blind hole in communication with the first control channel, a second blind hole in communication with the second control channel and a third blind hole communicating the first blind hole with and the second blind hole.

10. A double-acting hydraulic cylinder for use in an exercising apparatus to provide a resistance to a user thereof, comprising:

a cylindrical body comprising an outer wall and an inner wall and defining a front end and a rear end;

a piston rod extending into an inner space of the inner wall and attached with a piston to divide the inner space into a front chamber and a rear chamber;

a communicating tube extending between the outer and inner walls;

a rear seat mounted on the rear end of the cylindrical body and adapted to be fixedly attached to an exercising apparatus, comprising a first communicating passage communicating the communicating tube with the rear chamber and a first bypass communicating a space defined between the outer and inner walls with the rear chamber;

a first blocking member provided in the rear chamber for normally closing the first bypass, said first blocking member opening the first bypass when the piston is forced to move toward the front end;

a front seat mounted on the front end of the cylindrical body and defining a first passage extending therethrough;

a block mounted between the inner wall and the piston rod and located a distance behind the front seat, said block defining a plurality of second passages extending therethrough and communicating with the front chamber and the first passage in the front seat and a second L-shaped bypass communicating the space defined between the inner and outer walls with the front chamber;

a cup-shaped stop member mounted between the inner wall and the piston rod and located a distance behind the block, said stop member having a front end clamped between the block and the inner wall and defining a plurality of bores in a rear side thereof;

a second blocking member provided in the front chamber and located between the stop member and the block;

a spring compressed between the second blocking member and the stop member to push the second blocking member toward the second L-shaped bypass and thus the second L-shaped bypass being normally closed by the second blocking member, said second blocking member opening the second bypass when the piston is forced to moved toward the rear end of the cylindrical body;

a sleeve rotatably mounted around the piston rod and located at a front of the front seat, said sleeve defining a first control channel in communication with the first passage of the front seat, a second control channel in communication with the communicating tube and a hole in communication with said first and second control channels, said first and second control channels respectively having a variable depth along their lengths;

a control ring fixedly mounted on the sleeve so that when the control ring is rotated, the sleeve rotates accordingly; and a mounting ring mounted between the sleeve and the control ring, said mounting ring having a rear end hermetically and fixedly connected with a front end of the outer wall and an inner periphery hermetically engaging with the sleeve.

* * * * *